US010011450B2

(12) United States Patent
Michler et al.

(10) Patent No.: US 10,011,450 B2
(45) Date of Patent: Jul. 3, 2018

(54) WEB PROCESSING ROLL HAVING DIRECTIONAL VACUUM PORTS

(71) Applicants: James R. Michler, Ashland, WI (US); Richard D. Bretting, Ashland, WI (US); Greg M. Kauppila, Ashland, WI (US)

(72) Inventors: James R. Michler, Ashland, WI (US); Richard D. Bretting, Ashland, WI (US); Greg M. Kauppila, Ashland, WI (US)

(73) Assignee: C.G. Bretting Manufacturing Co., Inc., Ashland, WI (US)

( * ) Notice: Subject to any disclaimer, the term of this patent is extended or adjusted under 35 U.S.C. 154(b) by 0 days.

(21) Appl. No.: 15/218,502

(22) Filed: Jul. 25, 2016

(65) Prior Publication Data

US 2017/0050816 A1 Feb. 23, 2017

Related U.S. Application Data

(60) Provisional application No. 62/206,123, filed on Aug. 17, 2015.

(51) Int. Cl.
*B65H 20/12* (2006.01)
*B65H 27/00* (2006.01)

(52) U.S. Cl.
CPC ..... *B65H 20/12* (2013.01); *B65H 27/00* (2013.01); *B65H 2402/11* (2013.01); *B65H 2404/135* (2013.01); *B65H 2404/1362* (2013.01); *B65H 2406/33* (2013.01); *B65H 2406/332* (2013.01); *B65H 2511/214* (2013.01)

(58) Field of Classification Search
CPC ..... B65H 20/12
See application file for complete search history.

(56) References Cited

U.S. PATENT DOCUMENTS 843,781 A 2/1907 Wheeler
4,466,605 A 8/1984 Leuthold et al.
(Continued)

FOREIGN PATENT DOCUMENTS

DE 27 37 882 A1 3/1979
DE 10043855 A1 3/2002
EP 1415941 B1 4/2007

OTHER PUBLICATIONS

Machine Translation of DE 27 37 882 A1, Mar. 1, 1979. (Year: 1979).*

*Primary Examiner* — William E Dondero
(74) *Attorney, Agent, or Firm* — Reinhart Boerner Van Deuren P.C.

(57) ABSTRACT

A web processing roll for handling a web of material using vacuum is provided. The web processing roll includes a roll body. The roll body defines an outer periphery against which the web of material is held. The roll body defines a vacuum passage. At least one first vacuum hole fluidly connects to the vacuum passage provides vacuum proximate the outer periphery of the roll body to hold the web of material against the outer periphery with vacuum supplied to the at least one first vacuum hole by the vacuum passage. A first flow path of the vacuum hole extends at a first angle that is non-perpendicular to the rotational axis and is directed, at least in part, axially toward one of the first and second ends at the first outlet end of the at least one first vacuum hole.

23 Claims, 13 Drawing Sheets

(56) References Cited

U.S. PATENT DOCUMENTS

| | | | | |
|---|---|---|---|---|
| 4,917,665 | A | 4/1990 | Couturier | |
| 5,913,268 | A | 6/1999 | Jackson et al. | |
| 7,458,927 | B2 | 12/2008 | Kauppila et al. | |
| 2004/0159999 | A1 | 8/2004 | Dematteis | |
| 2006/0266465 | A1* | 11/2006 | Meyer ..... | A61F 13/15699 156/250 |

* cited by examiner

WEB PROCESSING ROLL HAVING DIRECTIONAL VACUUM PORTS

CROSS-REFERENCE TO RELATED PATENT APPLICATIONS

This patent application claims the benefit of U.S. Provisional Patent Application No. 62/206,123, filed Aug. 17, 2015, the entire teachings and disclosure of which are incorporated herein by reference thereto.

FIELD OF THE INVENTION

This invention generally relates to web processing rolls that utilize vacuum to hold a web of material against an outer periphery of the web processing roll.

BACKGROUND OF THE INVENTION

Web processing rolls such as rolls used for handling and manipulating web of material and sheets formed from the web of material such as napkin folders, singlefold interfolders, and multifold interfolders all use vacuum to hold the web onto and transfer the web between rolls in the system. Additionally, some machines use vacuum to actually manipulate the web of material such as to make folds in the web of material.

All of these machines connect vacuum holes in the face of the rolls to a vacuum passage within the roll. The vacuum passage typically runs the length of the roll. Due to the width of some rolls, the vacuum passage is typically connected to a source of vacuum at both ends of the roll such that air flows in one direction (i.e. toward one of the ends) in one half of the vacuum passage and in the opposite direction (i.e. toward the other end) in the other half of the vacuum passage. However, in narrower embodiments, the vacuum source may be connected to a single end of the roll.

The source of vacuum will typically include valving for selectively turning on and off the vacuum supplied to the vacuum passage.

Pressure drop down the length of the axial vacuum passages is a significant problem as folders get wider and faster. The pressure drop manifests as reduced vacuum toward the center of the machine. The pressure drop is caused by axial vacuum passages too small for the air flow through them. Roll bodies do not have enough space to make the axial vacuum passages large enough to reduce the pressure drop.

Even when the cross-section of the vacuum passages is increased, such as in a tube-in-tube design, the pressure drop can be significant enough to effect vacuum performance.

The pressure drop down the length of an axial vacuum passage has at least two components. One component is friction between the flowing air and the passage wall. The other component is flow blockage caused by jets of air entering the vacuum passage from the holes in the roll face.

What is needed is a way to get more air flow with less pressure drop through the axial vacuum passages without making the vacuum passages larger.

BRIEF SUMMARY OF THE INVENTION

Embodiments of the invention include improved web processing rolls for processing a web of material that vacuum secure the web of material to the outer periphery of the rolls. Vacuum is supplied through a vacuum passage internal the roll body of the web process roll and then supplied to the outer periphery through a plurality of individual vacuum holes. The flow path of the vacuum holes is aligned, in part, axially with the direction of flow of air through the vacuum passage to reduce pressure drop.

In one embodiment a web processing roll for handling a web of material using vacuum including a roll body and at least one first vacuum hole is provided. The roll body extends axially between first and second ends and is configured to rotate about a rotational axis extending between the first and second ends. The roll body defines an outer periphery against which the web of material is held using the vacuum. The roll body defines a vacuum passage extending axially therein providing axial air flow generally parallel to the rotational axis when a vacuum is supplied to the vacuum passage. The vacuum passage is positioned radially inward from the outer periphery. The at least one first vacuum hole is fluidly connected to the vacuum passage. The at least one first vacuum hole extends through the outer periphery and is positioned to provide vacuum proximate the outer periphery of the roll body to hold the web of material against the outer periphery with vacuum supplied to the at least one first vacuum hole by the vacuum passage. The at least one first vacuum hole has a first inlet end and a first outlet end, the first inlet end is at an intersection of the at least one first vacuum hole with the outer periphery and the first outlet end is at the intersection of the at least one first vacuum hole with the vacuum passage. The at least one first vacuum hole defines a first flow path extending from the first inlet to the first outlet. The first flow path extends at a first angle that is non-perpendicular to the rotational axis and is directed, at least in part, axially toward one of the first and second ends at the first outlet end of the at least one first vacuum hole.

In one embodiment, the first flow path is substantially perpendicular to the rotational axis at the first inlet end of the at least one first vacuum hole.

In one embodiment, the first flow path extends at a second angle relative to the rotational axis proximate the inlet end that is closer to perpendicular than the first angle.

In one embodiment, the first flow path is a substantially smooth curve between the first inlet end and the first outlet end.

In one embodiment, the at least one first vacuum hole has a first cross-sectional shape proximate the first inlet end and a second cross-sectional shape proximate the first outlet end that is different than the first cross-sectional shape. In a more particular embodiment, the first cross-sectional shape is rectangular and the second cross-sectional shape is circular.

In one embodiment, a first cross-sectional area of the at least one first vacuum port proximate the first inlet end is different than a second cross-sectional area of the at least one first vacuum port proximate the first outlet end. The first cross-sectional area is defined in a first plane normal to the first flow path and the second cross-sectional area is defined in a second plane normal to the first flow path.

In one embodiment, the first cross-sectional area is less than the second cross-sectional area.

In one embodiment, a cross-sectional area of the at least one first vacuum port increases when moving in a direction extending from the first inlet end toward the first outlet end.

In one embodiment, the first flow path transitions circumferentially when moving from the first inlet end toward the first outlet end such that the first flow path proximate the first inlet end is at a first angular position relative to the rotational axis and the first flow path proximate the first outlet end is at a second angular position relative to the rotational. The first and second angular positions being different.

In one embodiment, a vacuum hole insert defines at least a portion of the at least one first vacuum hole.

In one embodiment, the vacuum hole insert is removably mounted to a remainder of the roll body.

In one embodiment, the vacuum hole insert is 3D-printed.

In one embodiment, the at least one first vacuum hole is formed directly by the roll body, such as by machining.

In one embodiment, at least one second vacuum hole is provided. The at least one second vacuum hole is fluidly connected to the vacuum passage and extends through the outer periphery and is positioned to provide vacuum proximate the outer periphery of the roll body to hold the web of material against the outer periphery with vacuum supplied to the at least one second vacuum hole by the vacuum passage. The at least one second vacuum hole has a second inlet end and a second outlet end. The second inlet end is at an intersection of the at least one second vacuum hole with the outer periphery and the second outlet end is at the intersection of the at least one second vacuum hole with the vacuum passage. The at least one second vacuum hole defines a second flow path extending from the second inlet to the second outlet. The second flow path extends at a second angle that is non-perpendicular to the rotational axis and is directed axially toward one of the first and second ends at the second outlet end of the at least one second vacuum hole.

In one embodiment, the second angle is different than the first angle.

In one embodiment, the second angle is the same as the first angle.

In one embodiment, the first flow path extends towards the first end of the roll body and the second flow path extends towards the second end and opposite the first flow path.

In one embodiment, the at least one first vacuum hole is positioned axially closer to the first end than the at least one second vacuum hole.

In one embodiment, the at least one first vacuum hole is located at a first position along the rotational axis and the at least one first vacuum hole is located at a second position along the rotational axis. The first position being closer to the first end than the second position. A first average cross-sectional area of the at least one first vacuum hole is less than a second average cross-sectional area of the at least one first vacuum hole. The first flow path of the at least one first vacuum hole at the first outlet end and the second flow path of the at least one first vacuum hole at the second outlet end both being angled toward the first end.

Further embodiments include a vacuum valve proximate the first end of the roll body for selectively supplying a vacuum to the vacuum passage.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
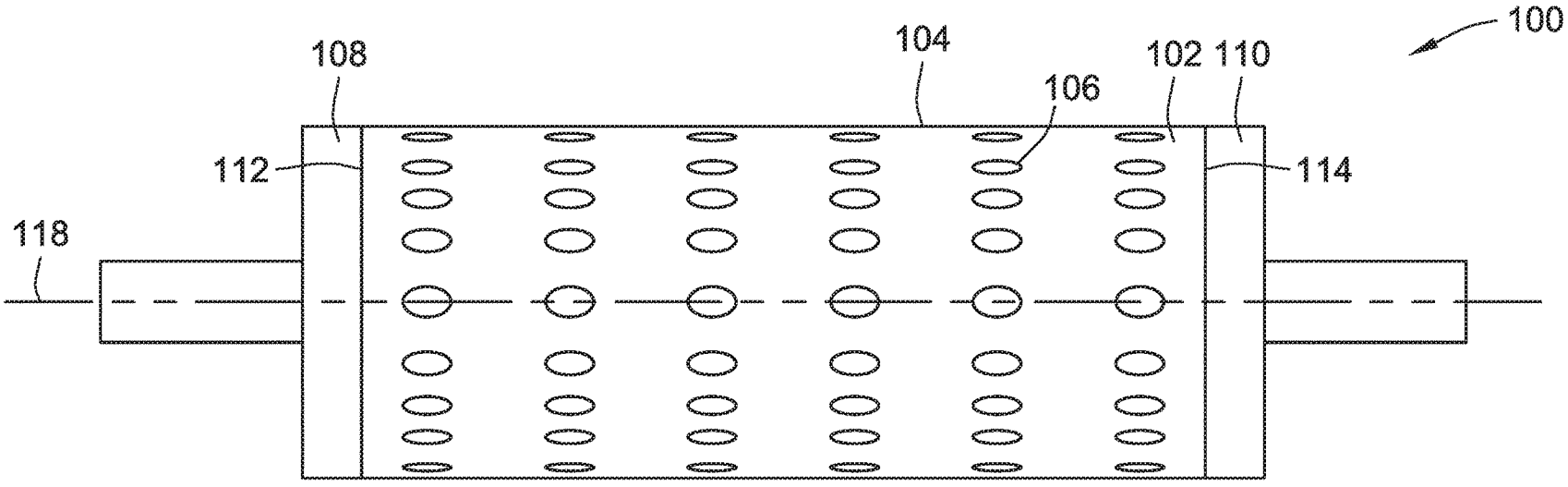
FIG. 1 is a schematic simplified illustration of a processing roll according to an embodiment of the invention.

FIG. 1 is a simplified schematic illustration of a web processing roll 100 for processing a web of material (not shown). The web of material may be a continuous web of material or a stream of sheets formed from the web of material. As used herein after "web" or "web of material" shall generically include both a continuous web or web separated into a stream of sheets.

Further, the web processing roll 100 is illustrated in schematic form but could take the form of many different types of rolls used for processing the web of material. For example, the web processing roll 100 could be a folding roll, a knife roll, a lap roll, a transfer roll, a retard roll, etc. that are used to process a web of material.

The web processing roll 100 includes a roll body 102 that defines an outer periphery 104 against which the web of material is held. A plurality of vacuum holes 106 extend through the outer periphery 104 and are operably fluidly coupled to a source of vacuum that extends through the interior of the roll body 102. The vacuum supplied by the vacuum holes 106 is used to selectively secure the web of material to the outer periphery 104.

The pattern of the location of the vacuum holes 106 in outer periphery 104 is merely schematic in FIG. 1 and different patterns and numbers of the vacuum holes 106 can exist depending on the size and function of the web processing roll 100.

Figure 2:
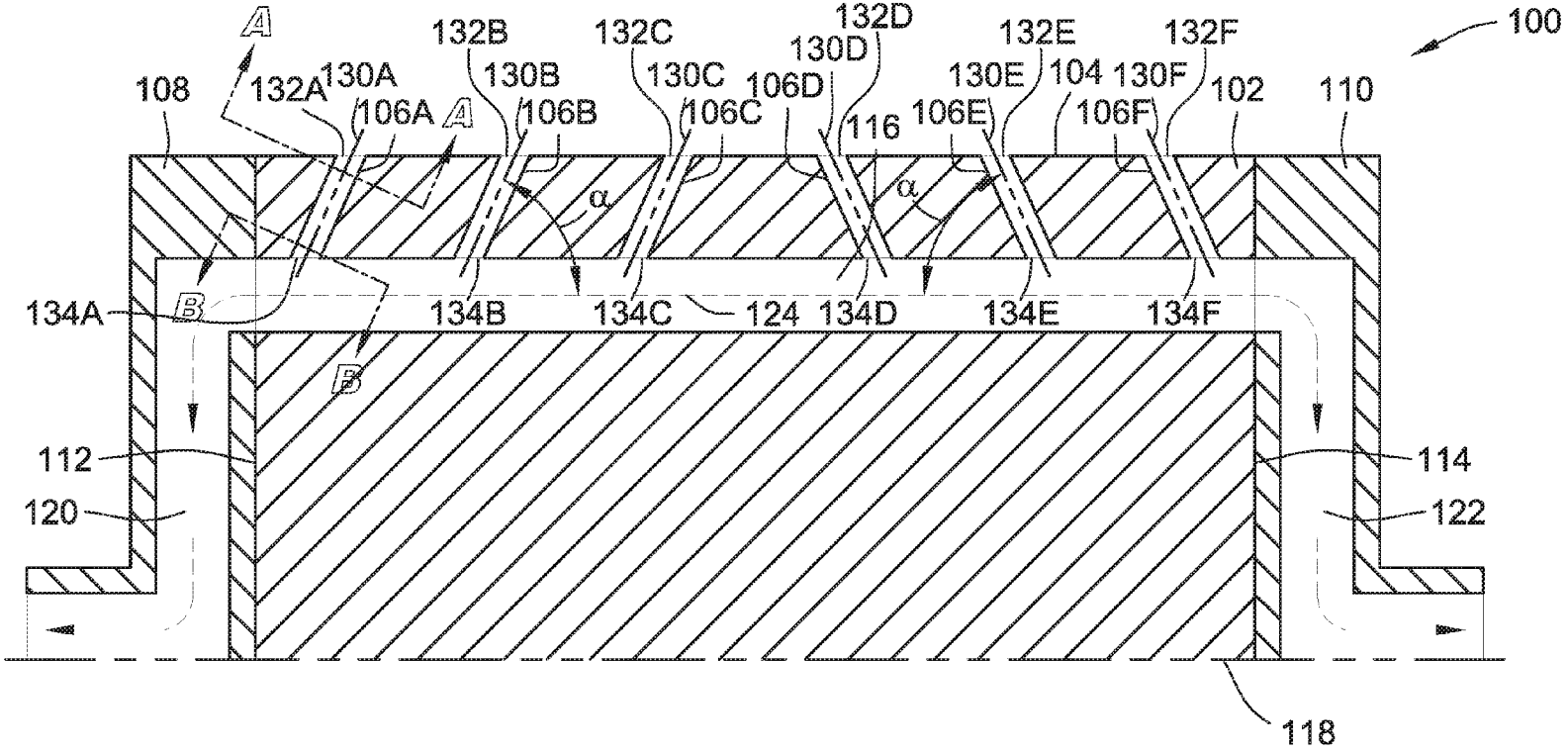
FIG. 2 is a simplified cross-sectional illustration of the processing roll of FIG. 1.

With additional reference to FIG. 2, the web processing roll 100 includes a pair of vacuum valves 108, 110 located at opposed first and second ends 112, 114 of the roll body 102, respectively. The vacuum valves 108, 110 operably and selectively fluidly communicate with a vacuum passage 116 that is in fluid communication with the vacuum holes 106 (reference character 106 will be used when the vacuum holes generically and, such as in FIG. 2, a letter will follow the reference character 106 when one or more specific vacuum hole(s) is/are being referenced).

In the illustrated embodiment, as the roll body 102 rotates about rotational axis 118, vacuum passage 116 will communicate with first and second vacuum passages 120, 122 of the first and second vacuum valves 108, 110. When the vacuum passage 116 is in fluid communication with first and second vacuum passages 120, 122 vacuum is supplied to the vacuum holes 106. When the vacuum passage 116 is not in fluid communication with the first and second vacuum passages 120, 122 vacuum is not supplied to the vacuum holes 106. As such, the we processing roll 100 can be configured to selectively turn on and turn off vacuum supplied at the outer periphery 104 of the roll body 102 to selectively grip and release the web of material based on the configuration of the vacuum valves 108, 110. While this is one method of providing valve control of the vacuum to the vacuum holes 106, other methods such as tube-in-a-tube style valve arrangements can also be implemented.

The vacuum passage 116 extends between the first and second ends 112, 114 of the roll body 102 and has a central axis 124 that extends between the first and second ends 112, 114 generally parallel to rotational axis 118 of the roll body 102.

As noted above, the pressure drop down the length of an axial vacuum passage has at least two components. One component is friction between the flowing air and the passage wall. The other component is flow blockage caused by jets of air entering the vacuum passage 116 from the holes 106 in the roll body 102. Unfortunately, because of this, the further a vacuum hole 106 is from the source of vacuum, e.g. vacuum valves 108, 110, the weaker the vacuum pressure will be at the outer periphery 104 of the roll body 102. For example, the vacuum pressure at vacuum hole 106A typically will be greater than the vacuum at vacuum hole 106C.

To combat this pressure drop problem, vacuum hole 106 defines a flow path 130 that extends from an inlet 132 at the outer periphery 104 to an outlet 134 at the vacuum passage 116. The flow path 130 has an axial component that is directed, at least in part, axially in line with the flow of air within the vacuum passage 116. By having the flow path 130 include an axial component, the air exiting the vacuum holes 106 is directed toward a corresponding one of ends 112, 114 of the roll body 102 as it mixes with the other air flowing within the vacuum passage 116. By directing the flow path 130 to be, at least partially, in line with the flow of air within the vacuum passage 116, the jets of air entering the vacuum passage 116 from the vacuum holes 106 creates less interference to the flow within the vacuum passage 116 resulting a smaller pressure drop.

In FIG. 2, the processing roll 100 includes six (6) vacuum holes 106A-106F. Three of the vacuum holes 106A-106C have flow paths 130A-130C have an axial component directed toward first end 112 while the other three vacuum holes 106D-106F have flow paths 130D-130F that have an axial component directed toward second end 114.

The flow paths 130A-130F define an angle $\alpha$ relative to central axis 124 of the vacuum passage 116, and consequently rotational axis 118, that is the same for all of the flow paths 130A-130F. Preferably, angle $\alpha$ is minimized so as to reduce interference created by the jets of air exiting the vacuum holes 106A-106F. In some embodiments, the angle $\alpha$ is less than 80 degrees and more preferably less than 60 degrees and even more preferably 45 degrees or less. In some embodiments, the angle $\alpha$ is 30 degrees or less.

Figure 3:
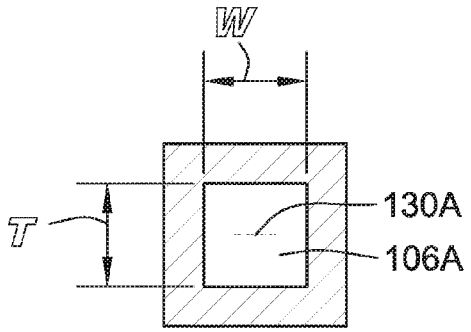
FIG. 3 is a partial cross-sectional illustration of a vacuum hole of the roll body of FIG. 2 taken about line A-A.
Figure 4:
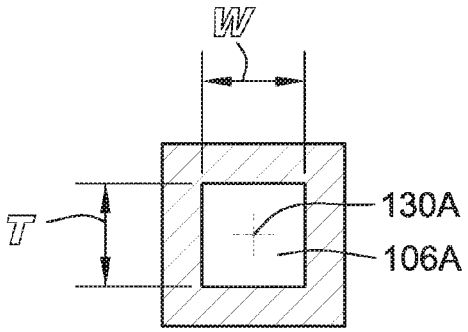
FIG. 4 is a partial cross-sectional illustration of a vacuum hole of the roll body of FIG. 2 taken about line B-B.

Further, in this embodiment, the cross-section of the vacuum holes 106 is generally constant from the inlet 132 to the outlet 134. With reference to FIGS. 3 and 4 which are cross-sections taken about lines A-A and B-B proximate the inlet 132A and outlet 134A of vacuum hole 106A, the cross-section of the vacuum hole 106A is rectangular in profile and has a width W and a thickness T that is constant the entire length of the flow path 130A. These cross-sections are taken in planes normal to the flow path 130A. Further, the flow path 130A is linear from the inlet 132A to the outlet 134A such that vacuum hole 106A is a straight rectangular bore extending between the outer periphery 104 and the vacuum passage 116. Again, in this embodiment, all of the vacuum holes 106A-106F are substantially identical except for their axial location along the rotational axis 118 of the roll body 102. Further, while illustrated as being rectangular in this embodiment, the cross-section could take other shapes such as circular similar to FIGS. 7 and 8 but with a contan cross-sectional area.

Figure 5:
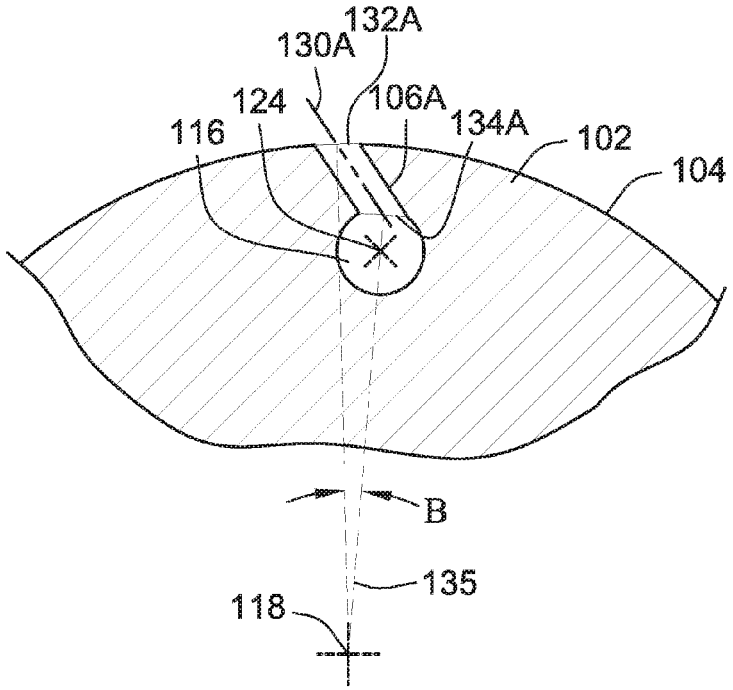
FIG. 5 is a schematic cross-sectional illustration of the processing roll of FIG. 2.

With reference to FIG. 5, a simplified illustration of vacuum hole 106A is illustrated. In this embodiment, the flow path 130A of vacuum hole 106A has a circumferential component (which may also be referred to as an angular component) at the outlet 134A relative to the rotational axis 118. As such, air exiting outlet 134A will be directed in a circumferential direction relative to rotational axis 118 as it enters the vacuum passage 116, not directly radially inward, when viewed axially down the rotational axis 118. In this embodiment, the location where the flow path 130A intersects the outer periphery 104 proximate the inlet 132A and intersects the vacuum passage 116 proximate the outlet 134A is angularly offset by angle $\beta$. Further, as illustrated in FIG. 5, the flow path 130A forms an angle with radially directed line 135 further illustrating that the flow path 130A has a circumferential component proximate outlet 134A.

Figure 6:
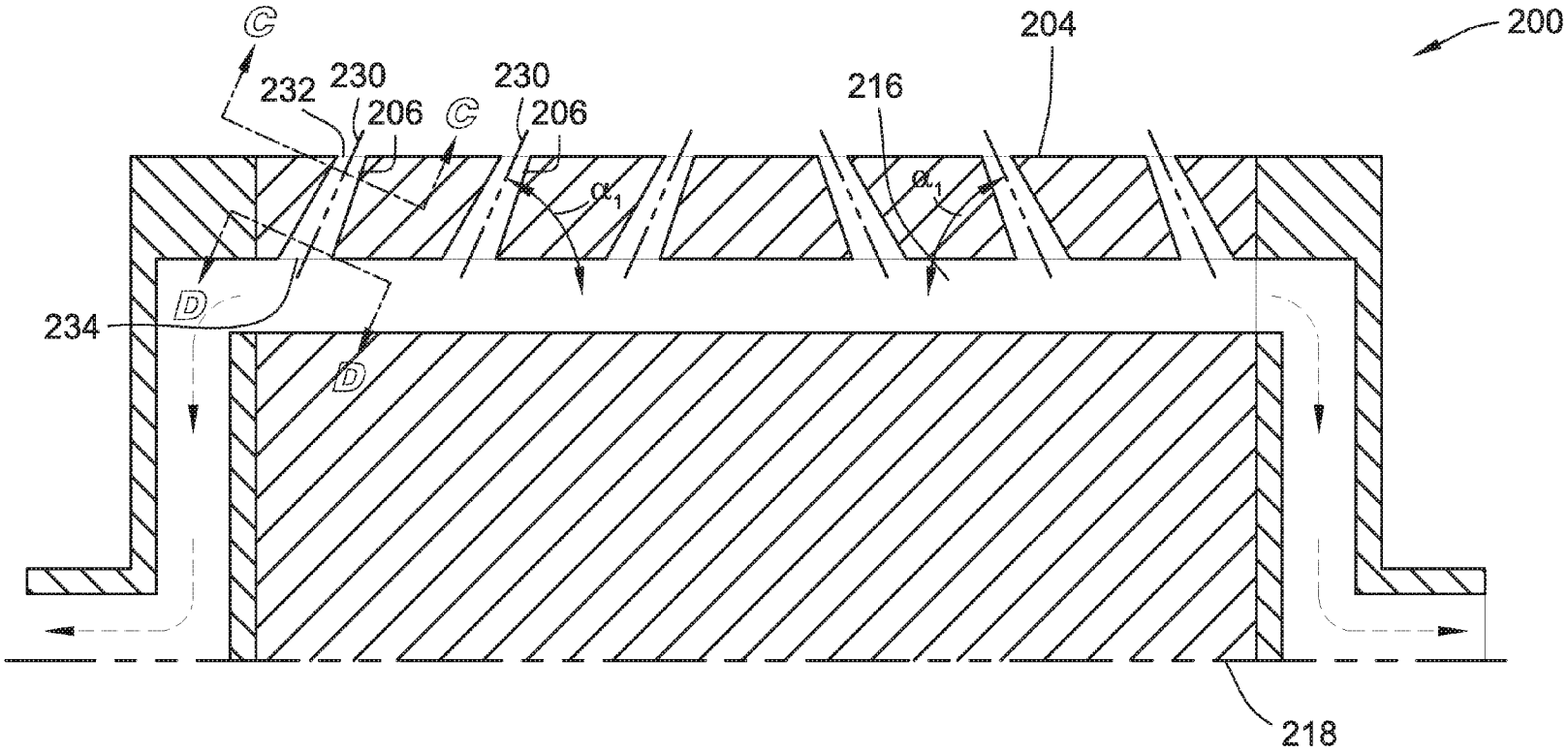
FIG. 6 is a simplified cross-sectional illustration of an alternative embodiment of the processing roll of FIG. 1.

FIG. 6 illustrates a further embodiment of a processing roll 200 similar to processing roll 100 in many respects. However, in this embodiment, the vacuum holes have a different configuration.

In FIG. 6, the vacuum holes 206 again have an axial component such that the flow paths 230 have an axial component proximate the outlets 234 where fluid exits the vacuum holes 206 and enters the vacuum passage 216 such as in the prior embodiment. However, in this embodiment, the cross-sectional size of the vacuum holes increases when traveling from the inlet 232 toward the outlet 234.

Figure 7:
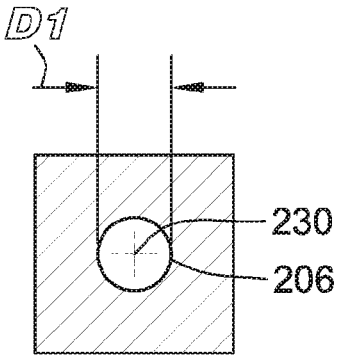
FIG. 7 is a partial cross-sectional illustration of a vacuum hole of the roll body of FIG. 6 taken about line C-C.
Figure 8:
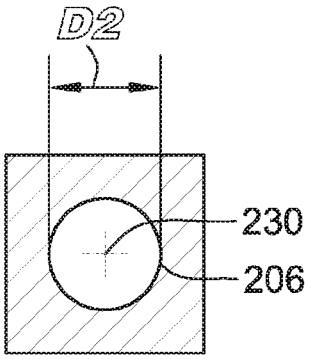
FIG. 8 is a partial cross-sectional illustration of a vacuum hole of the roll body of FIG. 6 taken about line D-D.
Figure 9:
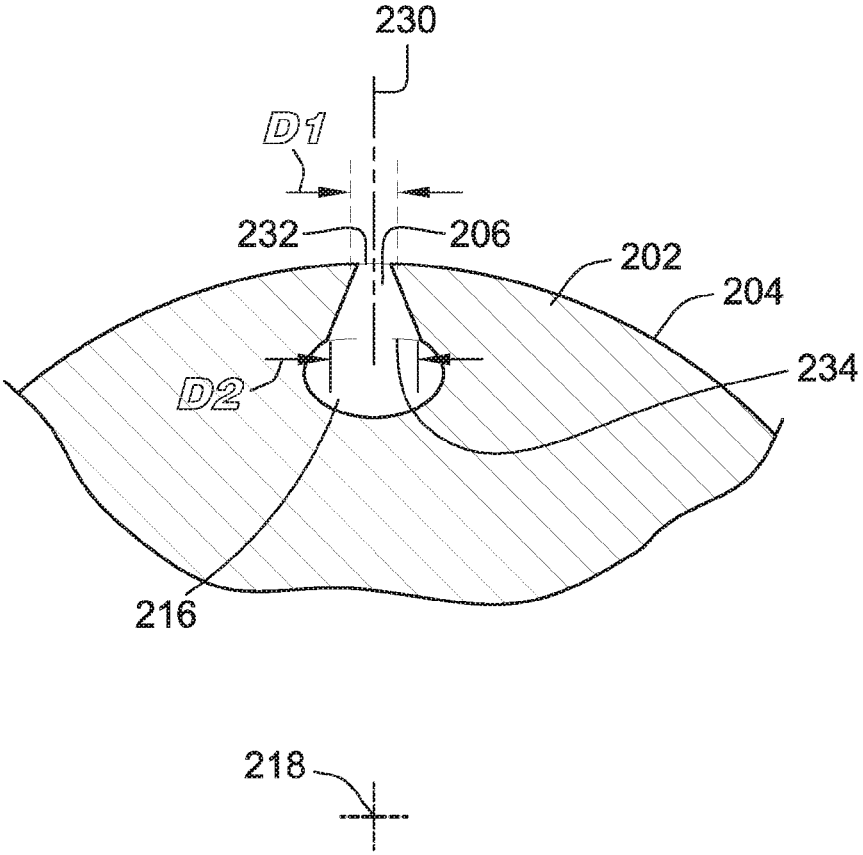
FIG. 9 is a schematic cross-sectional illustration of the processing roll of FIG. 6.

With additional reference to FIGS. 7 and 8 which are partial cross-sections take about lines C-C and D-D of FIG. 6 which defines planes normal to flow path 230, the cross-sectional shape of the vacuum hole 206 is circular. However, as illustrated in FIGS. 7 and 8, the diameter D1 of the vacuum hole 206 proximate the inlet 232 is less than the diameter D2 of the vacuum hole 206 proximate the outlet 234 such that the cross-sectional area of the vacuum hole 206 increases when traveling along flow path 230. This increase in diameter from D1 to D2 also illustrated in FIG. 9. The increase in cross-sectional area is believed to help reduce clogging of the vacuum holes due to contaminants such as dust or particles of the web of material thereby reducing maintenance of the web processing roll 200.

Additionally, in this embodiment, the flow paths 230 of the vacuum holes 206 are radially directed such that the vacuum holes 206 do not include any circumferential component. Further, in this embodiment, all of the vacuum holes 206 are identical except for their axial location along rotational axis 218. Further, the flow paths 230 have a constant angle α1 from the inlet 232 to the outlet 234 and the angle α1 is the same for all of the vacuum holes 206.

Figure 10:
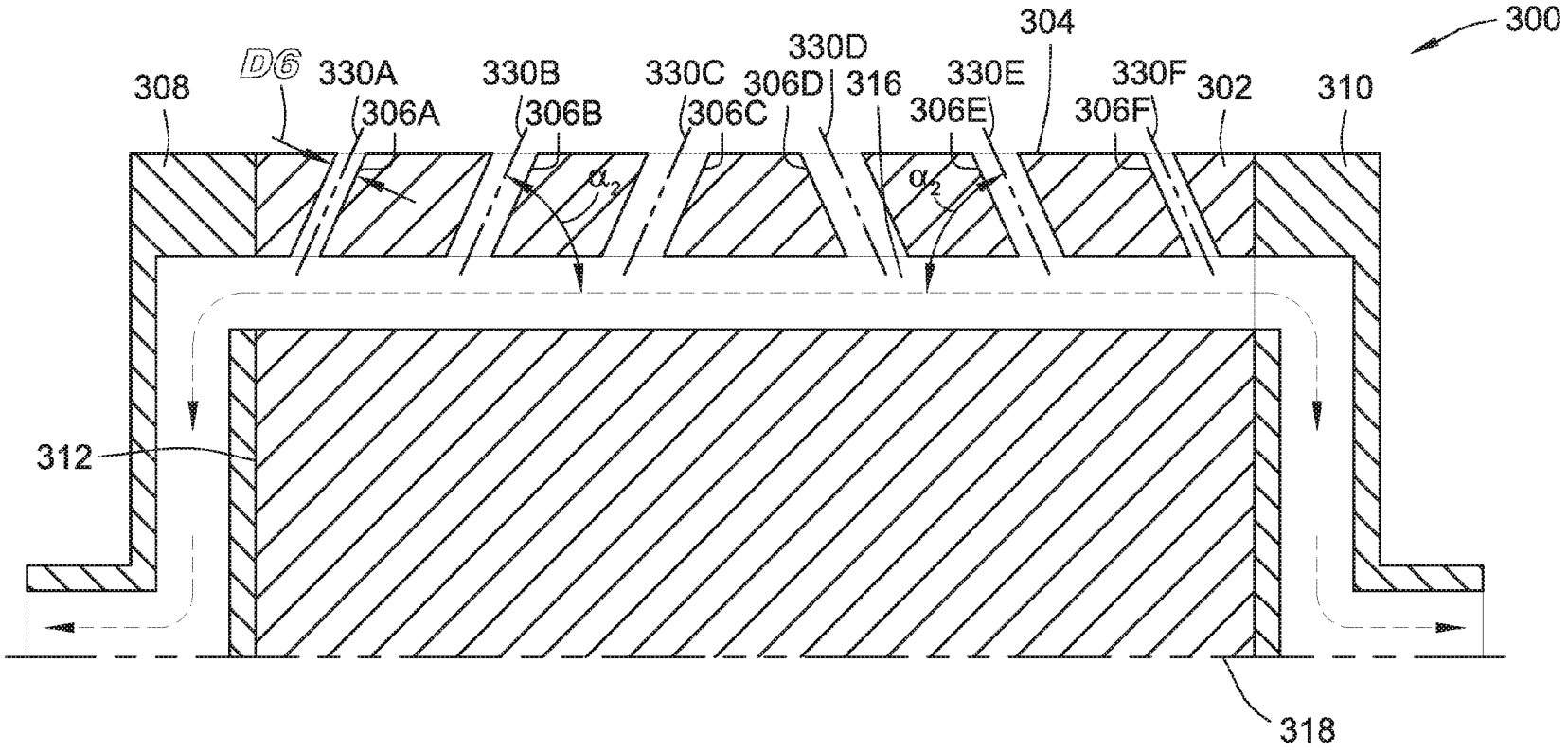
FIG. 10 is a simplified cross-sectional illustration of an alternative embodiment of the processing roll of FIG. 1.

FIG. 10 illustrates a further embodiment of a web processing roll 300 and roll body 302 thereof. In this embodiment, the cross-sectional shape and orientation of the flow paths 330A-330F of the vacuum holes 306A-306F is substantially identical to one another. As such, the angle α2 is substantially the same for all of the vacuum holes 306A-306F. However in this embodiment, the cross-sectional area of the vacuum holes 306A-306F increases when moving axially inward along rotational axis 318.

In FIG. 10, the cross-sectional shape of all of the vacuum holes 306A-306F is taken for example as circular. The diameters D6, D7, D8 of vacuum holes 306A-306C, respectively increase when moving axially inward along the rotational axis 318, i.e. the further from first end 318 and thus further from the vacuum source provided by vacuum valve 308. Thus, diameter D8 is greater than D7 which is greater than D6 with D8 being the largest and D6 being the smallest. The same configuration applies for vacuum holes 306D-306F, wherein the diameter of vacuum hole 306F is the smallest and vacuum hole 306D is the largest. Again, diameters D6, D7, D8 are all taken in planes normal to the flow paths 330A-330C. While not illustrated, in some embodiments, the individual vacuum hole cross-sectional area for all of the vacuum holes at a given angular location could remain the same but the density, e.g. number, of holes further from the vacuum source could be increased to compensate for any loss in vacuum pressure.

While vacuum holes 306A-306F are all illustrated as being straight bores, the increasing cross-sectional area could apply to other shapes such as the conical configuration of the prior embodiment as well.

Figure 11:
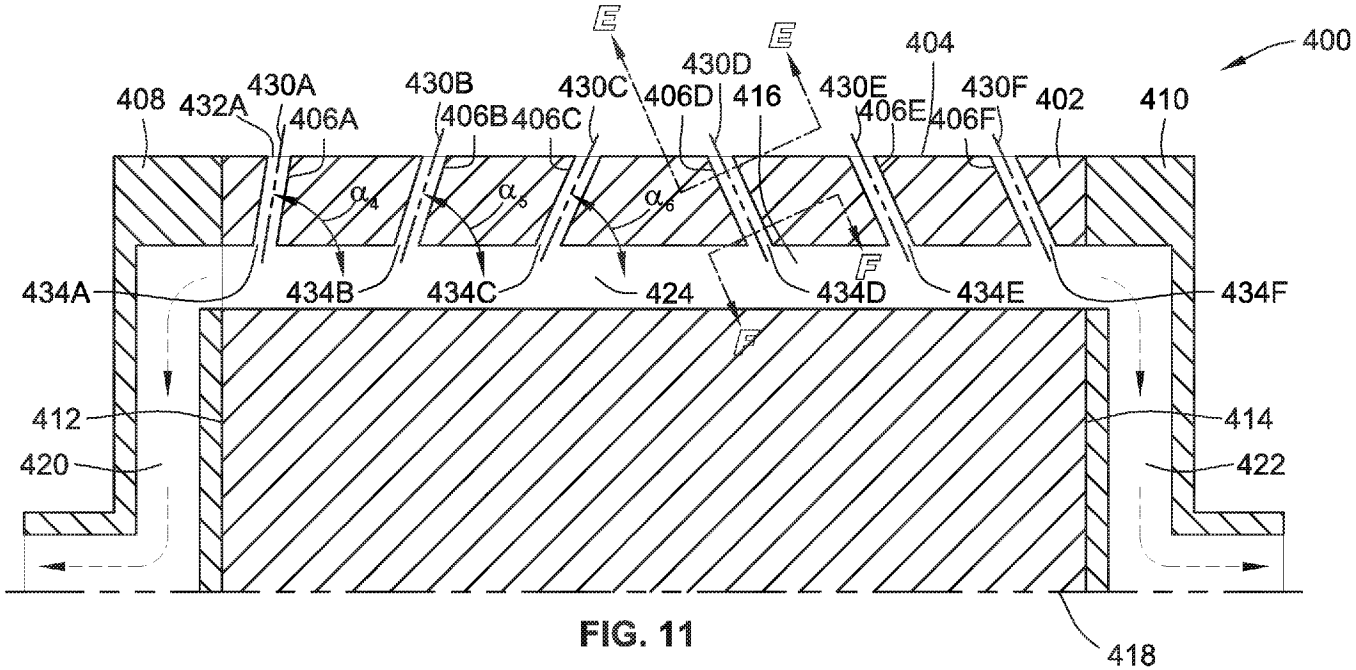
FIG. 11 is a simplified cross-sectional illustration of an alternative embodiment of the processing roll of FIG. 1.

FIG. 11 illustrates a further embodiment of a processing roll 400. The vacuum holes 406A-406F of this embodiment present several additional features. First, to attempt to better tailor the pressure drop when moving axially across the roll body 402 from the first end 412 toward the second end 414, the axial component of the flow paths 430A-430F such that the angles of the flow paths 430A-430F vary relative to the central axis 424 of the vacuum passage 416 as well as rotational axis 418. More particularly, the angle between the flow paths 430A-430F and the central axis 424 becomes less the further from the corresponding ends 412, 414. This allows the fluid exiting the corresponding vacuum holes 406A-406F to be closer to being in line with the flow of air through the vacuum flow passage the closer the vacuum hole 406A-406F is to the ends 412, 414 of the roll body 402. More particularly, with reference to vacuum holes 406A-406C, angle α4 is greater than angle α5 which is greater than α6. This particularly applies to the portion of the flow paths 430A-430C proximate the outlet 434A-434C of the vacuum holes 406A-406C. Vacuum holes 406D-406F are a mirror image of vacuum holes 406A-406C. However, it is contemplated that other sets of angles could be implemented where the angles α4-α6 increase when moving axially inward toward the center of the roll body 402. In this situation, it is contemplated that larger angles for the flow paths of the axially inner most vacuum holes (e.g. furthest from the vacuum source) will have less detrimental effect on the pressure drop due to their location within the flow of air through the vacuum passage.

Figure 13:
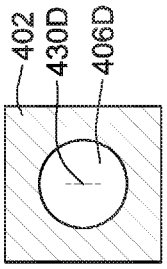
FIG. 13 is a partial cross-sectional illustration of a vacuum hole of the roll body of FIG. 11 taken about line F-F.
Figure 12:
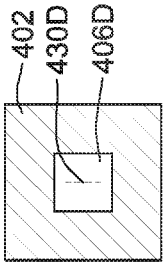
FIG. 12 is a partial cross-sectional illustration of a vacuum hole of the roll body of FIG. 11 taken about line E-E.

Second, another feature of the embodiment of FIG. 11 is illustrated in FIGS. 12 and 13 which are partial cross-sectional illustrations taken about lines E-E and F-F of FIG. 11. In this embodiment the cross-sectional shape of the vacuum holes 406A-406F changes when traveling along the flow paths 430A-430F from the inlet 432A-432F to the outlet 434A-434F.

As illustrated in FIGS. 12 and 13, the cross-section of vacuum hole 406D is rectangular and more preferably square proximate the inlet 432D and the cross-section of the vacuum hole 406D is circular proximate the outlet 434D. Again, the cross-sectional shapes are taken in planes normal to the flow path 430D. Ideally, the second cross-sectional shape is larger than the first cross-sectional shape to avoid any shelves or structures that could catch debris or act as an abrupt wall that would increase pressure drop through the vacuum holes 406A-406F. For example, the diagonal of the rectangle of FIG. 12 would have a dimension smaller than or equal to the diameter of the circle of FIG. 13.

Figure 14:
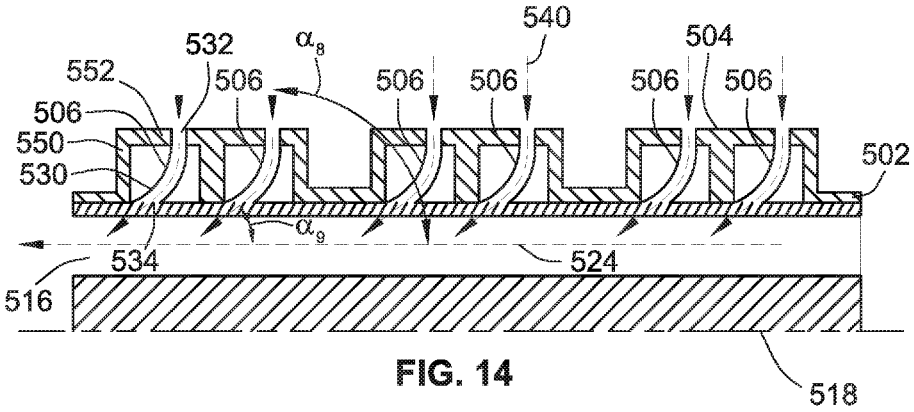
FIG. 14 is a simplified cross-sectional illustration of an alternative embodiment of the processing roll of FIG. 1.

FIG. 14 is a further embodiment of a roll body 502. In this embodiment, the flow paths 530 of the vacuum holes 506 are non-linear and have an arcuate path from the inlet 532 to the outlet 534. The curvature of the flow paths 530 is such that the portion of the flow paths 530 proximate the outlet 534 is extending in an axial direction in line with the flow of fluid within vacuum passage 516 such that the air exiting the vacuum holes 506 has an axial component to its flow when the air enters the vacuum passage 516. In this embodiment, the flow of air entering the vacuum holes 506, illustrated by arrow 540 is perpendicular to the central axis 524 of the vacuum passage 516 and rotational axis 518 such that the flow path 530 does not have an axial component proximate the inlet 532 as illustrated by α8. However, the flow path 530 does have an axial component proximate the outlet 534 due to the curvature of the vacuum hole 506. More particularly, the flow path 530 defines an outlet angle α9 with central axis 524 and rotational axis 518.

Figure 18:
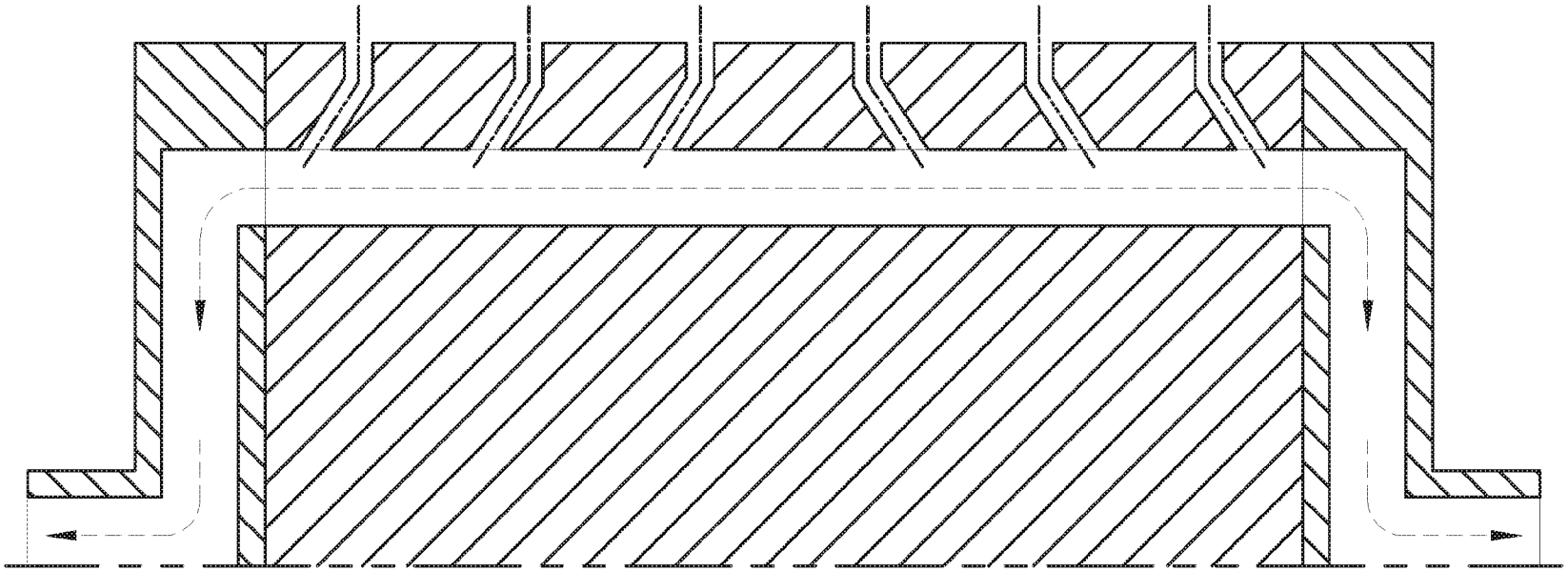
FIG. 18 is a simplified cross-sectional illustration of an alternative embodiment of the processing roll of FIG. 1.

While the vacuum holes 506 of FIG. 14 are illustrated as smooth curves, other embodiments could utilize two straight sections that extend at an angle relative to one another to provide a flow path that has an inlet angle α8 that is different than an outlet angle α9 such as illustrated in FIG. 18. By using the curved vacuum hole 506, in some embodiments, the outlet angle α9 can be less than 10 degrees, even more preferably less than 5 degrees and can also approach being 0 degrees while still providing a small axial footprint for the vacuum holes 506. This allows for even reduced interference of the flow of air within the vacuum passage 516 by the jets of air exiting the vacuum holes 506. The curved vacuum hole 506 allow for accommodating the grooves formed in the outer periphery of the roll body 502 which reduce the axial footprint available within which to locate the vacuum holes 506.

A further feature of the embodiment of FIG. 14 is that the vacuum holes 506 are formed in inserts 550 that are operably secured to the rest of the roll body 502. This arrangement allows for the formation of the complex shape of the vacuum holes 506 to be formed external to the roll body, i.e. not directly machined or otherwise formed into the roll body 502. In some embodiments, the complexity of the shape of the vacuum holes 506 results in undercuts or regions that cannot be easily machined, if at all. In some embodiments, the inserts 550 are formed by 3D printing the inserts to include the vacuum hole 506. Further, the inserts could be formed from separate parts that are assembled after formation. This would be particularly true if it were desired to machine the complex vacuum holes. Other forming methods could be implemented such as injection molding, cast, etc.

It is contemplated that the inserts 550 could be formed from metal or plastic materials. In situations where the insert 550 will not contact the web of material or other components of adjacent processing rolls, less durable materials could be used.

Preferably, but not necessarily, the inserts 550 are removably attached to the rest of the roll body 502 such that they can be replaced for maintenance or to modify the vacuum characteristics of the roll body 502. Further, the use of inserts allows for calibrating the vacuum of a given roll body 502 due to potential manufacturing tolerances and unexpected pressure drops.

In the illustrated embodiment, an insert carrier 552 extends over the inserts 550 and operably secures the inserts 550 to the remainder of the roll body 502. The carrier 552 in this embodiment forms a portion of the outer periphery 504 against which the web of material is adhered using the vacuum supplied using the vacuum holes 506. However, in other embodiments, the outermost portion of the insert could form a portion of the outer periphery of the roll body 502.

Again, all of the inserts 550 need not have a same shape, angle, size or orientation for the vacuum hole 506 within a given roll body 502 or at a same angular location about the rotational axis 518.

Figure 21:
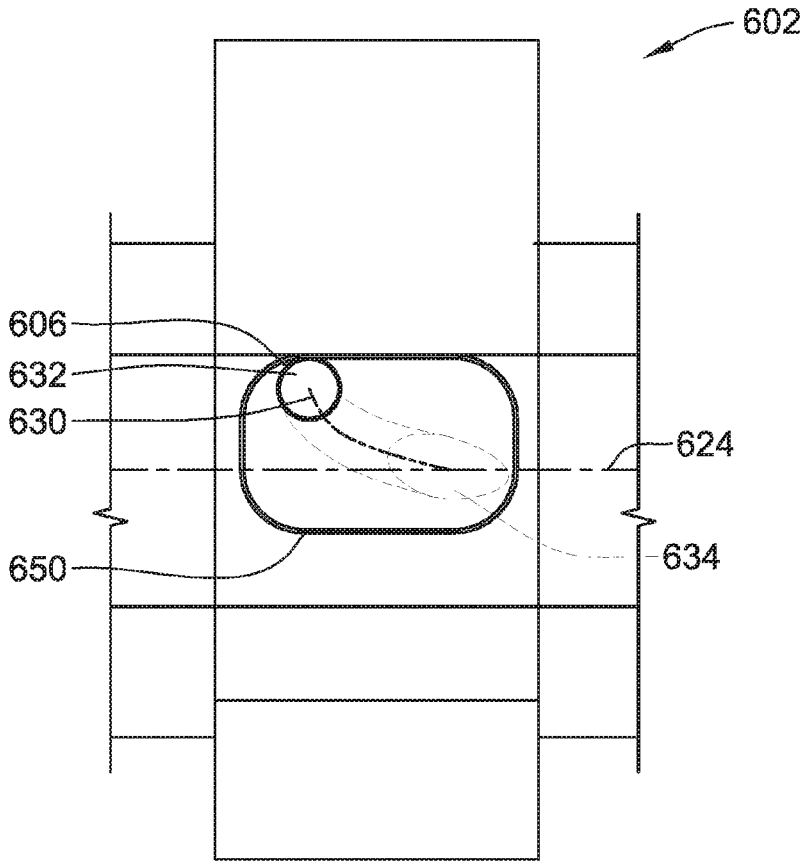
FIGS. 21-27 illustrate a further embodiment of a processing roll and inserts for forming the vacuum holes thereof.
Figure 22:
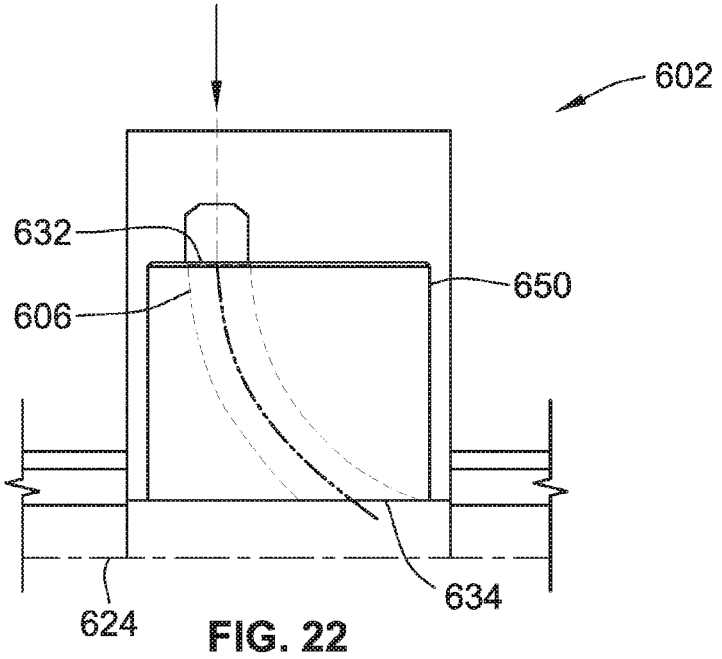
Figure 23:
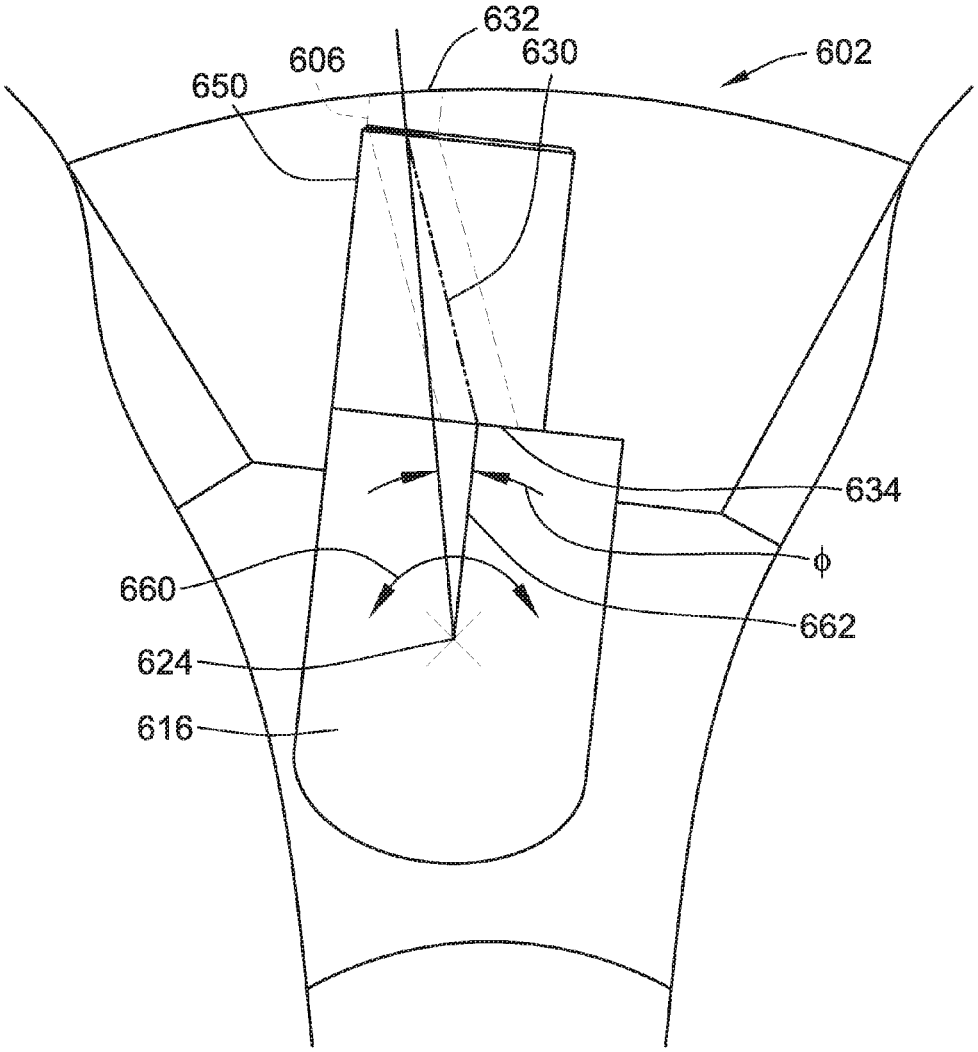
Figure 25:
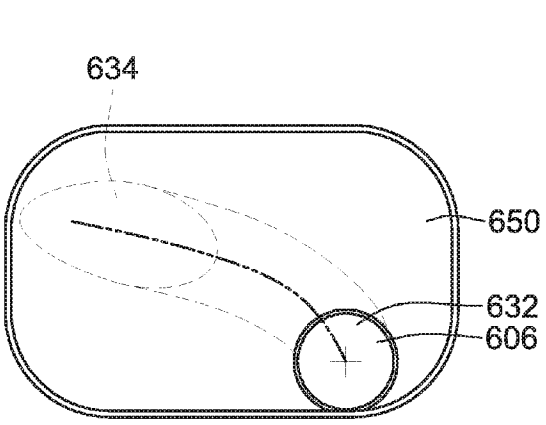
Figure 27:
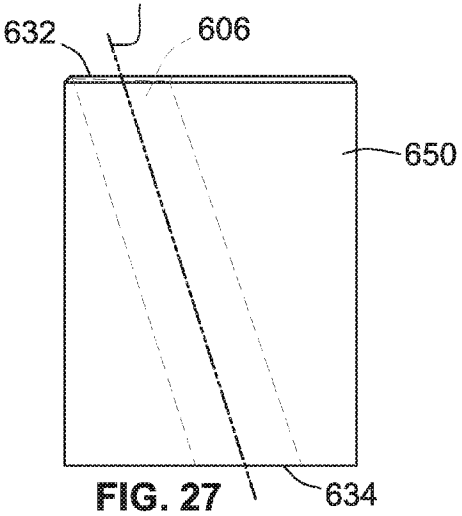
Figure 24:
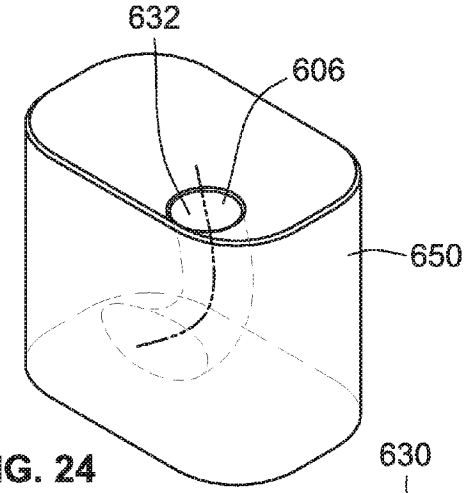
Figure 26:
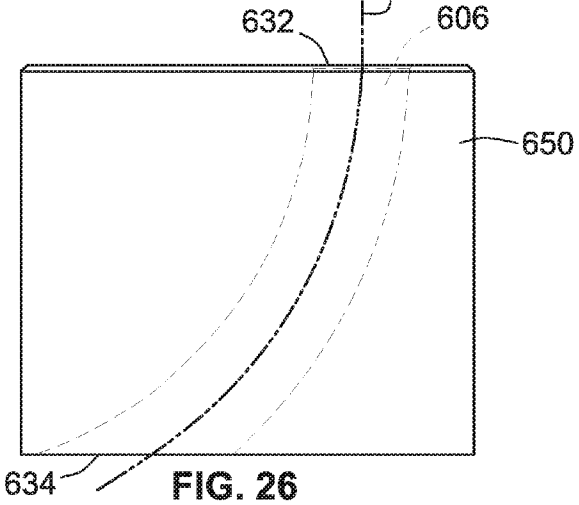

FIGS. 21-23 illustrate a further embodiment of a processing roll 602 using vacuum holes 606 similar to the vacuum holes 506 described above. The flow path 630 of the vacuum holes 606 are curved from the inlet end 632 to the outlet end 634 similar to the embodiment of vacuum hole 506.

However, the inlet 632 portion of the flow path 630 is angularly/circumferentially offset from the outlet portion of the flow path 630. However, the flow path 630 is designed to align the flow exiting the outlet 634 with the flow path 624 of the vacuum passage 616 such that the flow path 630 of the jets of air exiting the vacuum hole 606 into the vacuum passage 616 have substantially no circumferential or angular component. This is unlike the embodiment of FIG. 5. This configuration attempts to prevent any swirling of the air within vacuum passage 616 such as illustrated by arrow 660 due to the air jets having a circumferential/radial component when exiting outlet 634.

From the top view of FIG. 21, it can be seen that the portion of the flow path 630 proximate inlet 632 of the vacuum hole 606 extends at a non-zero $\lambda 1$ angle relative to the central axis 624 of the vacuum passage 616. However, the flow path 630 proximate the outlet 634 of the vacuum hole 606 is substantially parallel with the central axis 624 and thus has substantially zero angular/circumferential component such that all air exiting the vacuum hole 606 flows substantially axially toward the end of the roll body 602.

This embodiment again uses inserts 650 that form, at least, part of the vacuum hole 606 and particularly the complex profile that provides both axial directing of the jets of air towards the vacuum source as well as eliminating any angular component of the air jet due to the inlet 132 being angular offset by angle $\theta$ from a line (having reference character 662) passing through the center point 624 of the vacuum flow path and the intersection of the outlet 634 and the vacuum flow path.

FIGS. 24-27 illustrate the insert 650 removed from the rest of the roll body 602.

While various configurations of the vacuum holes have been described, it is directly contemplated that the various features can be mixed and matched depending on desired vacuum characteristics of a given roll body.

To test the concept, a test system was prepared. Two test samples of 70 inch PVC pipe were prepared and are illustrated in FIGS. 15 and 16.

Each pipe had seven (7) groups of holes with each group of holes including thirteen (13) axially spaced apart holes.

Figure 15:
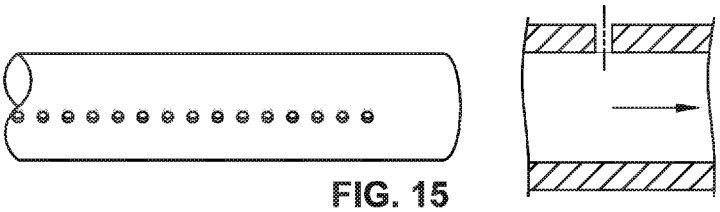
FIGS. 15 and 16 illustrate test apparatuses.
Figure 16:
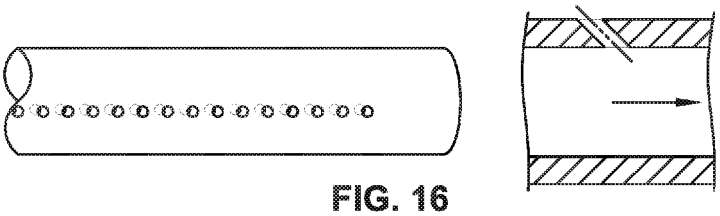

In FIG. 15, holes were provided that extend substantially perpendicular to the center of the pipe. In. FIG. 16, the holes were drilled at 45 degrees to the center of the pipe.

A vacuum source was then connected to one end of the pipes and the opposing end was closed off. The vacuum was measured at each group of holes. Three sets of data was collected and illustrated in FIG. 17. The first set of data is for the pipe illustrated in FIG. 15 and is illustrated by the line that includes diamond markers.

The second set of data is for the pipe illustrated in FIG. 16 with the 45 degree holes with the direction of the flow path of the holes aligned with the direction of flow of air through the pipe, i.e. the holes are directed toward the end of the pipe were the vacuum was supplied. This data is represented by the line in FIG. 17 with the square markers.

A third set of data was gathered where the vacuum was supplied to the opposite end of the pipe of FIG. 16 such that the air exiting the vacuum holes was traveling in a direction extending away from the end to which the vacuum was being supplied. This data is represented by the line in FIG. 17 with the triangular markers.

This data illustrates that the vacuum down the length of the tube dropped 51% with the perpendicular holes and dropped only 17% with the 45 degree holes aligned with the air flow. It is notable that the vacuum loss down the length of the tube decreased by ⅔ with the entering air partially axially aligned with the air flow in the tube with the angled holes. As such, with the angled holes, the vacuum actually increased at the far end of the tube, i.e. proximate the closed end and furthest from the vacuum source. This is believed to be due to a vacuum boost effect provided by the jets of air that was greater than the vacuum loss from friction against the tube walls. This further supports that the vacuum jets that enter perpendicularly into the air flow within the vacuum passage are a significant if not largest source of pressure loss within the system.

Figure 17:
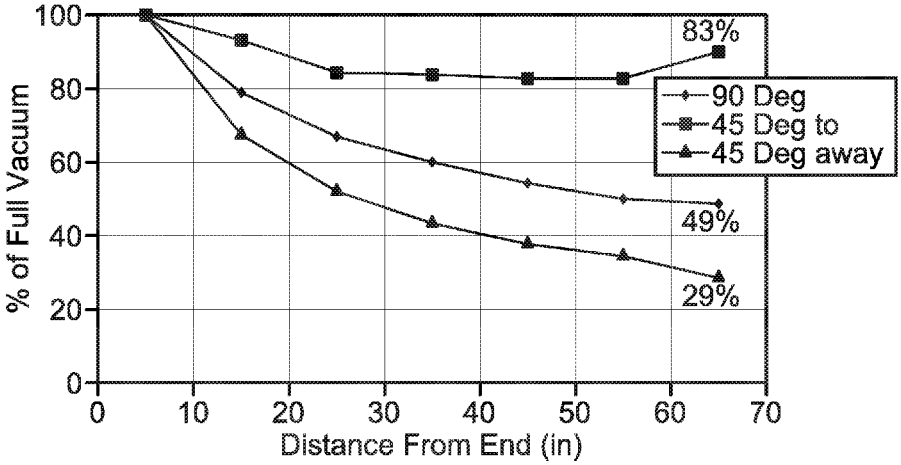
FIG. 17 is a graph of test results using the test apparatuses of FIGS. 15 and 16.

Further, FIG. 17 illustrates that there was a 71% vacuum decrease when the air jets were pushing against the direction of the air flow within the tube, i.e. where the air exiting the vacuum holes was directed in a direction away from the vacuum source.

Figure 19:
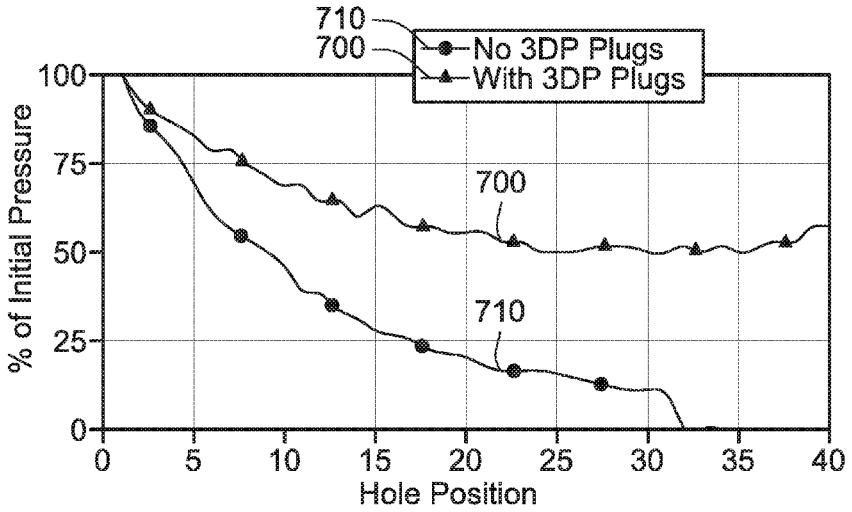
FIG. 19 illustrates the percent of original pressure along a 135" processing roll with vacuum supplied from both ends using angled vacuum holes simulated by using a roll half the length with a single vacuum supply source.

FIG. 19 illustrates a further test done to test the effects of angled vacuum holes for use in rolls having an axial length of 135 inches. The test fixture was one half of a 135 inch roll and vacuum was applied at one end at 14 inches of mercury.

The top line that includes the triangles identified with reference character 700 included angled vacuum holes that axially directed the air jets exiting the vacuum holes towards the vacuum source. The bottom line identified with reference character 710 had perpendicularly directed vacuum holes that created air jets that were not aligned with the flow of air within the corresponding vacuum passage coupled to the vacuum source.

As illustrated, after hole position 31 for the system that included perpendicular vacuum holes, the vacuum pressure dropped to almost zero such that virtually zero vacuum would be used supplied to the sheet on the outer periphery of the processing roll. However, when using the angled vacuum holes the vacuum stayed at least 50% of the initial vacuum of 14 inches of mercury. As such, the use of perpendicular holes would make such a wide roll would prevent the particular roll to reach the widths of 135 inches as there would be insufficient vacuum pressure at the central vacuum holes.

Figure 20:
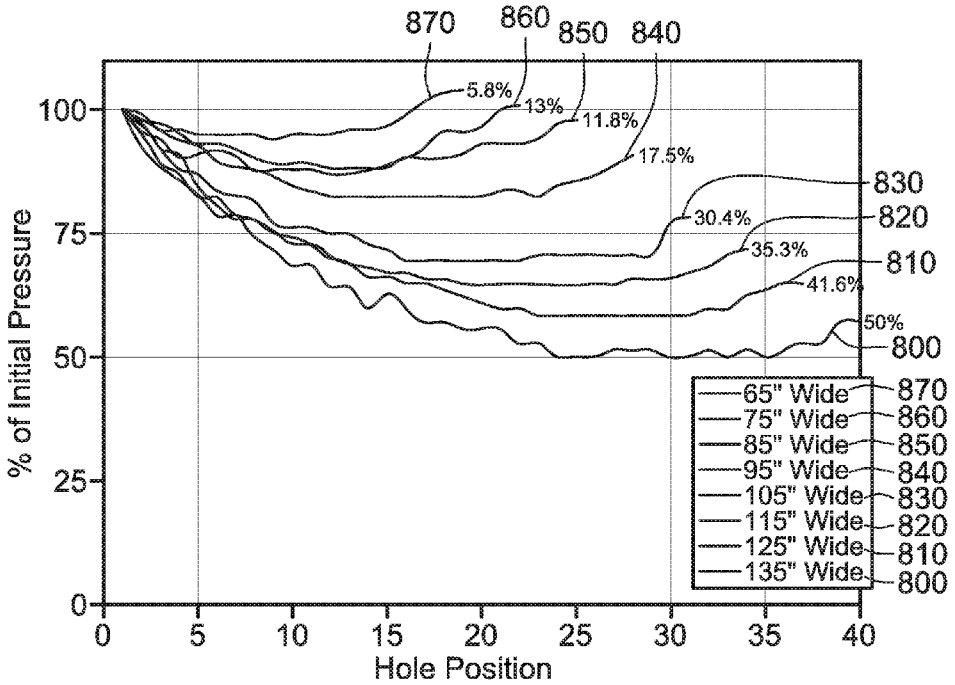
FIG. 20 illustrates the percent of original pressure along various processing rolls with vacuum supplied from both ends using angled vacuum holes simulated by using rolls half the length with a single vacuum supply source.

FIG. 20 shows the percentage of pressure drop against the position along the roll for different length rolls. Line 800 (which is the same as line 700 in FIG. 19) simulates 135" roll by being a half of 135" roll but with vacuum supplied at a single end of the roll. Each of the other lines represent rolls that are 10 inches shorter by providing a test sample that is 5 inches shorter (i.e. half of the 10 inch increment).

An interesting phenomenon was created for the shorter roll such as the 65 inch and 75 inch roll simulations in that the pressure at the final vacuum holes was actually greater than the initial pressure. However, all of the graphed data illustrates that the vacuum holes at the center of the roll will have a higher value than other vacuum holes that are closer to the vacuum source. For instance, with reference to line 800, vacuum holes 39 and 40 had greater values than vacuum holes 21-38.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A web processing roll for handling a web of material using vacuum, comprising:

a roll body extending axially between first and second ends and configured to rotate about a rotational axis extending between the first and second ends;

the roll body defining an outer periphery against which the web of material is held;

the roll body defining a vacuum passage extending axially therein providing axial air flow generally parallel to the rotational axis, the vacuum passage being positioned radially inward from the outer periphery;

at least one first vacuum hole fluidly connected to the vacuum passage and extending through the outer periphery and positioned to provide vacuum proximate the outer periphery of the roll body to hold the web of material against the outer periphery with vacuum supplied to the at least one first vacuum hole by the vacuum passage;

the at least one first vacuum hole having a first inlet end and a first outlet end, the first inlet end being at an intersection of the at least one first vacuum hole with the outer periphery and the first outlet end being at the intersection of the at least one first vacuum hole with the vacuum passage;

the at least one first vacuum hole defining a first flow path extending from the first inlet to the first outlet;

the first flow path extending at a first angle that is non-perpendicular to the rotational axis and is directed, at least in part, axially toward one of the first and second ends at the first outlet end of the at least one first vacuum hole; and the first flow path extending at a second angle relative to the rotational axis proximate the inlet end that is closer to perpendicular than the first angle.

2. The web processing roll of claim 1, wherein the first flow path is substantially perpendicular to the rotational axis at the first inlet end of the at least one first vacuum hole.

3. The web processing roll of claim 1, wherein the first flow path is a substantially smooth curve between the first inlet end and the first outlet end.

4. The web processing roll of claim 1, wherein the at least one first vacuum hole has a first cross-sectional shape proximate the first inlet end and a second cross-sectional shape proximate the first outlet end that is different than the first cross-sectional shape.

5. The web processing roll of claim 4, wherein the first cross-sectional shape is rectangular and the second cross-sectional shape is circular.

6. The web processing roll of claim 1, wherein a first cross-sectional area of the at least one first vacuum port proximate the first inlet end is different than a second cross-sectional area of the at least one first vacuum port proximate the first outlet end, the first cross-sectional area being defined in a first plane normal to the first flow path and the second cross-sectional area being defined in a second plane normal to the first flow path.

7. The web processing roll of claim 6, wherein the first cross-sectional area is less than the second cross-sectional area.

8. The web processing roll of claim 1, wherein a cross-sectional area of the at least one first vacuum port increases when moving in a direction extending from the first inlet end toward the first outlet end.

9. The web processing roll of claim 1, wherein the first flow path transitions circumferentially when moving from the first inlet end toward the first outlet end such that the first flow path proximate the first inlet end is at a first angular position relative to the rotational axis and the first flow path proximate the first outlet end is at a second angular position relative to the rotational, the first and second angular positions being different.

10. The web processing roll of claim 1, further comprising a vacuum hole insert, at least a portion of the at least one first vacuum hole being formed by the vacuum hole insert.

11. The web processing roll of claim 10, wherein the vacuum hole insert is removably mounted to a remainder of the roll body.

12. The web processing roll of claim 10, wherein the vacuum hole insert is 3d-printed.

13. The web processing roll of claim 1, wherein the at least one first vacuum hole is formed directly by the roll body.

14. The web processing roll of claim 1, further including:

at least one second vacuum hole fluidly connected to the vacuum passage and extending through the outer periphery and positioned to provide vacuum proximate the outer periphery of the roll body to hold the web of material against the outer periphery with vacuum supplied to the at least one second vacuum hole by the vacuum passage;

the at least one second vacuum hole having a second inlet end and a second outlet end, the second inlet end being at an intersection of the at least one second vacuum hole with the outer periphery and the second outlet end being at the intersection of the at least one second vacuum hole with the vacuum passage, the at least one second vacuum hole defining a second flow path extending from the second inlet to the second outlet;

the second flow path extends at a third angle that is non-perpendicular to the rotational axis and is directed axially toward one of the first and second ends at the second outlet end of the at least one second vacuum hole.

15. The web processing roll of claim 14, wherein the third angle is different than the first angle.

16. The web processing roll of claim 14, wherein the third angle is the same as the first angle.

17. The web processing roll of claim 14, wherein the first flow path extends towards the first end of the roll body and the second flow path extends towards the second end.

18. The web processing roll of claim 17, wherein at least one first vacuum hole is positioned axially closer to the first end than the at least one second vacuum hole.

19. The web processing roll of claim 14, wherein the at least one first vacuum hole is located at a first position along the rotational axis and the at least one second vacuum hole is located at a second position along the rotational axis, the first position being closer to the first end than the second position, wherein a first average cross-sectional area of the at least one first vacuum hole is less than a second average cross-sectional area of the at least one second vacuum hole, the first flow path of the at least one first vacuum hole at the first outlet end and the second flow path of the at least one second vacuum hole at the second outlet end are both being directed toward the first end.

20. The web processing roll of claim 1, further comprising a vacuum valve proximate the first end of the roll body for selectively supplying a vacuum to the vacuum passage.

21. A web processing roll for handling a web of material using vacuum, comprising:

a roll body extending axially between first and second ends and configured to rotate about a rotational axis extending between the first and second ends;

the roll body defining an outer periphery against which the web of material is held;

the roll body defining a vacuum passage extending axially therein providing axial air flow, the vacuum passage being positioned radially inward from the outer periphery;

first and second vacuum holes fluidly connected to the vacuum passage and extending through the outer periphery and positioned to provide vacuum proximate the outer periphery of the roll body to hold the web of material against the outer periphery with vacuum supplied to the first and second vacuum holes by the vacuum passage;

the first vacuum hole being positioned axially along the rotational axis closer to the first end than the second vacuum hole, the first and second holes being positioned axially between the first end and an axial center of the roll body;

the first vacuum hole having a first inlet end and a first outlet end, the first outlet end being at the intersection of the first vacuum hole with the vacuum passage;

the first vacuum hole defining a first flow path extending from the first inlet to the first outlet;

the first flow path extending at a first angle that is non-perpendicular to the rotational axis and is directed, at least in part, axially toward the first end at the first outlet end of the first vacuum hole; the first flow path extending at a second angle relative to the rotational axis proximate the inlet end that is closer to perpendicular than the first angle;

wherein vacuum produced by the first vacuum hole is less than vacuum being produced at the second vacuum hole.

22. A vacuum hole insert for use with a processing roll for handling a web of material using vacuum, the processing roll having a roll body extending axially between first and second ends and configured to rotate about a rotational axis extending between the first and second ends, the roll body defining an outer periphery against which the web of material is held, the roll body defining a vacuum passage extending axially therein providing axial air flow generally parallel to the rotational axis, the vacuum passage being positioned radially inward from the outer periphery, the vacuum hole insert comprising:

at least one first vacuum hole configured to be fluidly connected to the vacuum passage and to extend through the outer periphery and positioned to provide vacuum proximate the outer periphery of the roll body to hold the web of material against the outer periphery with vacuum supplied to the at least one first vacuum hole by the vacuum passage when mounted to the roll body;

the at least one first vacuum hole having a first inlet end and a first outlet end, the first inlet end being at an intersection of the at least one first vacuum hole with the outer periphery, when mounted to the roll body, and the first outlet end being at the intersection of the at least one first vacuum hole with the vacuum passage, when mounted to the roll body;

the at least one first vacuum hole defining a first flow path extending from the first inlet to the first outlet;

the first flow path extending at a first angle that is non-perpendicular to the rotational axis and is directed, at least in part, axially toward one of the first and second ends at the first outlet end of the at least one first vacuum hole, when mounted to the roll body; and the first flow path extending at a second angle relative to the rotational axis proximate the inlet end that is closer to perpendicular than the first angle, when mounted to the roll body.

23. A method of handling a web of material on a processing roll using vacuum, the method comprising:

supplying vacuum within a vacuum passage within a roll body of the processing roll having a rotational axis extending between first and second ends;

supplying vacuum to an outer periphery of the roll body through vacuum holes fluidly connecting the vacuum passage with the outer periphery;

wherein:

at least one of the vacuum holes having a first inlet end and a first outlet end, the first inlet end being at an intersection of the at least one vacuum hole with the outer periphery and the first outlet end being at an intersection of the at least one vacuum hole with the vacuum passage;

the at least one vacuum hole defining a first flow path extending from the first inlet to the first outlet;

the first flow path extending at a first angle that is non-perpendicular to the rotational axis and is directed, at least in part, axially toward one of the first and second ends at the first outlet end of the at least one vacuum hole;

the first flow path extending at a second angle relative to the rotational axis proximate the inlet end that is closer to perpendicular than the first angle;

directing air passing through the at least one of the vacuum holes due to the vacuum in the vacuum passage axially towards, at least in part, an end of the roll body due to the first angle of the first flow path at the first outlet end of the at least one vacuum hole.

* * * * *